United States Patent [19]

Anzai et al.

[11] 4,208,985

[45] Jun. 24, 1980

[54] APPARATUS FOR MONITORING THE CONCENTRATION OF TONER IN A DEVELOPER MIX

[75] Inventors: Masayasu Anzai; Isamu Terashima, both of Hitachi, Japan

[73] Assignees: Hitachi, Ltd.; Hitachi Koki Co., Ltd., both of Japan

[21] Appl. No.: 957,096

[22] Filed: Nov. 3, 1978

[30] Foreign Application Priority Data

Nov. 7, 1977 [JP] Japan ..... 52-132537

[51] Int. Cl.[2] ..... B05C 11/00

[52] U.S. Cl. ..... 118/712; 73/421 R; 118/689

[58] Field of Search ..... 73/421 R; 118/646, 689, 118/690; 324/204

[56] References Cited

U.S. PATENT DOCUMENTS 3,526,338 9/1970 Goodrich et al. ..... 118/646
3,572,551 3/1971 Gillespie et al. .

FOREIGN PATENT DOCUMENTS 52-125338 of 1977 Japan .
52-125339 of 1977 Japan .

*Primary Examiner*—S. Clement Swisher

*Attorney, Agent, or Firm*—Craig & Antonelli

[57] ABSTRACT

Apparatus for monitoring the concentration of toner in a mass of developer mix including the toner and carrier particles, having a sampling cylinder inside which the developer mix flows. An accumulating cylinder is disposed over the sampling cylinder. At the upper end part of the accumulating cylinder, a guide plate is disposed by which the developer mix is supplied to the accumulating cylinder. At the lower end part of the accumulating cylinder, a developer mix supplying roll is disposed by which the developer mix at a fixed flow rate is supplied to the upper end opening of the sampling cylinder. On the other hand, at the lower end opening of the sampling cylinder, there is disposed a magnet roll by which the developer mix at a fixed flow rate is discharged from inside the sampling cylinder. The flow rate of the developer mix to be supplied to the sampling cylinder is set to be greater than the flow rate of the developer mix to be discharged, so that part of the developer mix supplied towards the sampling cylinder overflows from the upper edge of the sampling cylinder. Therefore, the developer mix inside the sampling cylinder flows in a stable state. A detecting coil is disposed on the outer periphery of the sampling cylinder, and detects the toner concentration of the developer mix in the form of an inductance.

14 Claims, 6 Drawing Figures

APPARATUS FOR MONITORING THE CONCENTRATION OF TONER IN A DEVELOPER MIX

BACKGROUND OF THE INVENTION

This invention relates to apparatus for monitoring the concentration of toner in a developer mix for use in developing equipment of an electrostatic-printing system, an electrophotographic system etc.

In an electrostatic-printing system wherein carrier particles and toner are mixed in a fixed proportion and are used as a developer mix, it is desirable that the mixing ratio (or toner concentration) in the developer mix between the carrier particles and the toner be controlled to be substantially constant. To this end, the toner concentration in the developer mix needs to be detected accurately.

For example, in apparatus for monitoring and controlling the concentration of toner in a developer mix as disclosed in U.S. Pat. No. 3,572,551, a sampling tube and a return tube are disposed at the bottom of a reservoir. A screw is mounted within the return tube, and the developer mix accumulated in the bottom of the reservoir slides through the sampling tube and up is passed through the sampling return tube by the rotation of the screw. A sampling coil is wound on the outer periphery of the sampling tube. The toner concentration of the developer mix inside the sampling tube is detected in the form of the inductance of the sampling coil.

Such apparatus can precisely measure the toner concentration under fixed conditions. However, it is prone provide to erroneous measurements due to fluctuations in conditions, e.g., the temperature and the humidity. This is because, on account of the changes of the temperature and the humidity, the quantity of slide of the developer mix varies and the quantity of movement or the density of the developer mix inside the sampling tube varies.

Also Japanese Patent Laying-open No. 52-125339 discloses apparatus for detecting the concentration of toner, in which a developer mix is introduced into the hole of a hollow bobbin and toner concentration is detected by a detection coil wound on the hollow bobbin. As in the foregoing apparatus, however, such apparatus has the disadvantage of liability to erroneously measure the toner concentration of the developer mix on account of fluctuations in the temperature, the humidity etc.

In addition, another apparatus for detecting the concentration of toner is known from Japanese Patent Laying-open No. 52-125338.

SUMMARY OF THE INVENTION

An object of this invention is to provide apparatus for monitoring the toner concentration of a developer mix which is less susceptible to fluctuations in conditions such temperature and humidity.

The above-mentioned object is accomplished in that means for limiting the flow rate of a developer mix are disposed at an inlet and an outlet of a sampling cylinder into which the developer mix is introduced and which is equipped with means for detecting the toner concentration of the developer mix. In this manner the state of the developer mix inside the cylinder is stabilized irrespective of temperatures and humidities.

DETAILED DESCRIPTION OF THE PREFERRED EMBODIMENTS

Figure 1:
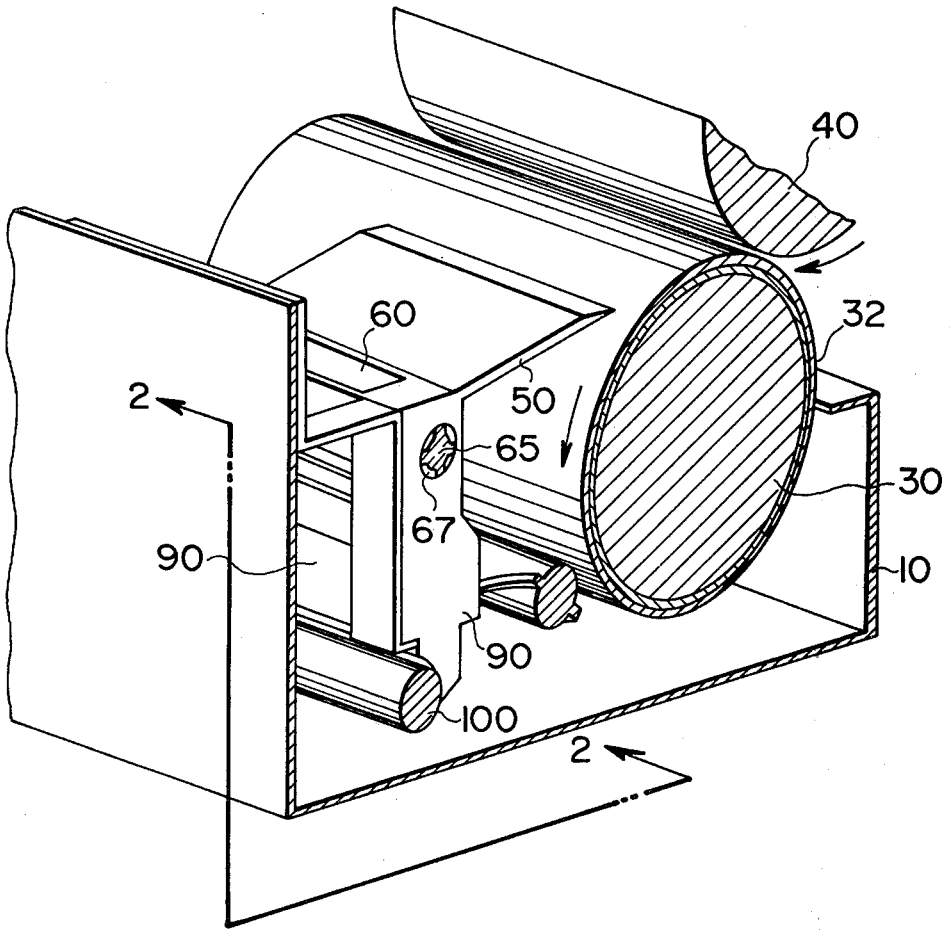
FIG. 1 is a perspective view showing a part of an electrostatic-printing system in which an apparatus according to this invention for monitoring the toner concentration of a developer mix is installed.
Figure 2:
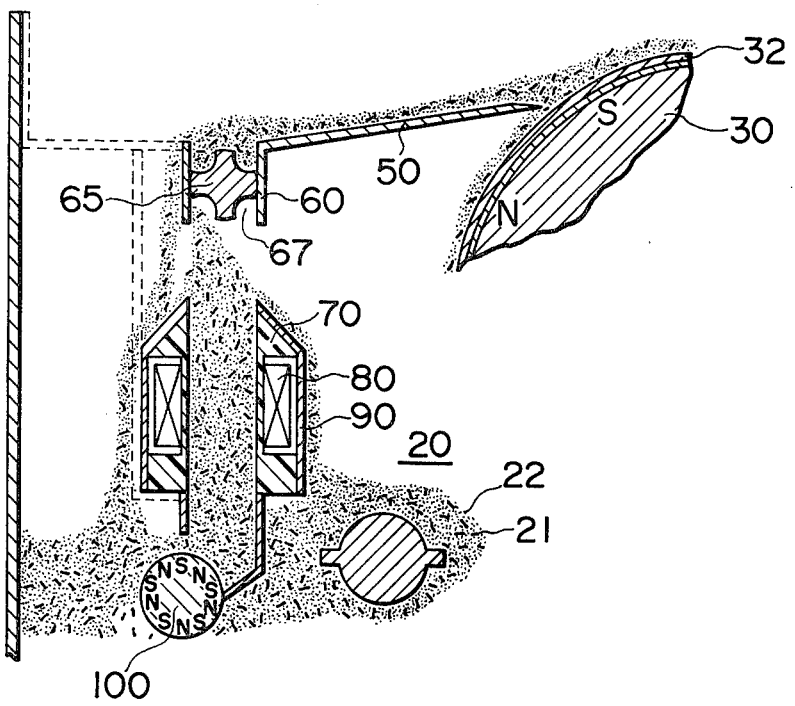
FIG. 2 is a sectional view of the apparatus for monitoring the toner concentration of a developer mix taken along line 2—2 in FIG. 1.

Referring to FIGS. 1 and 2 in which the same reference numerals designate the same parts, a developer mix 20 (not shown in FIG. 1) is received in a developer reservoir 10. The developer mix 20 consists of magnetic carrier particles 21 and toner 22. The mix is attracted on the outer periphery of a rotary sleeve 32 by the magnetic force of a fixed magnet roll 30, and is transported in the direction of arrow with the rotation of the rotary sleeve 32. The developer mix 20 attracted on the outer surface of the rotary sleeve 32 comes into contact with the surface of a recording medium or photosensitive drum 40 bearing an electric latent image in the course of the transportation, and develops the latent image by the toner. Thereafter, the remaining developer mix 20 is returned to the developer reservoir 10, mixed and stirred again, and used again.

After having contacted the photosensitive drum 40, a part of the developer mix 20 attracted on the surface of the rotary sleeve 32 is stripped off from the surface of the rotary sleeve 32 by a guide plate 50 and is moved on the guide plate 50 towards an opening at the upper end of an accumulating cylinder 60. The position of the guide plate 50 is adjusted so that the flow rate of the developer mix 20 on the guide plate 50 may become approximately 80 cc per second. A developer supply roll 65 is disposed in the interior of the accumulating cylinder 60. Four grooves 67 are formed in the surface of the supply roll 65. As the supply roll 65 rotates, the developer mix 20 in an amount corresponding to the capacity of the grooves 67 falls into a sampling cylinder 70. The number of revolutions of the supply roll 65 is controlled so that the quantity of fall may become approximately 20 cc per second. Accordingly, the developer mix 20 overflows from the upper edge of the accumulating cylinder 60. The sampling cylinder 70 is made of a nonmagnetic insulator, and has its upper and lower ends made open. A detecting coil 80 is wound on the outer periphery of an intermediate part of the sampling cylinder, and its outer periphery is further covered with a magnetic shield plate 90. Desirably, the shield plate 90 is constructed so as not to form a short-circuit ring which is electromagnetically coupled with the detecting coil 80. The upper end opening of the sampling cylinder 70 is provided so as to receive the developer mix 20 supplied from the accumulating cylinder 60. At the lower end opening of the sampling cylinder 70, there is disposed a discharge magnet roll 100 which discharges the developer mix 20 inside the sampling cylinder 70 to the exterior. The discharge magnet roll 100 discharges the developer mix 20 by the rotation thereof, and the number of revolutions of the magnet roll 100 is controlled so that the quantity of discharge may become approximately 13 cc per second. Since, in this manner, the quantity of the developer mix 20 which is fed from the upper end opening of the sampling cylinder 70 is larger than the quantity which is discharged from the lower end opening thereof, part of the developer mix 20 supplied to the upper end opening of the sampling cylinder 70 overflows from the edge of this opening. It is desirable that the flow rate of the developer mix 20 which falls from the accumulating cylinder 60 towards the upper end opening of the sampling cylinder 70 is 1.5 to 2 times the flow rate of the developer mix which is discharged from the lower end opening of the sampling cylinder 70. It is also desirable that the descending speed of the developer mix 20 within the sampling cylinder 70 is set so as to become lower than the free fall speed. Further, as regards the shape of the detecting coil 80, a rectangle the aspect ratio of which is 3 or greater is desirable in order to enhance the S/N (signal-to-noise) ratio of a detection signal.

In the construction as stated above, during the operation of the electrostatic-printing system, the developer mix 20 is led from the surface of the rotary sleeve 32 to the accumulating cylinder 60 by the guide plate 50. While part of the developer mix is stored in the accumulating cylinder 60, the remainder overflows from the upper edge of the accumulating cylinder 60. Accordingly, the quantity of the developer mix 20 inside the accumulating cylinder 60 is substantially constant. Further, the developer mix 20 inside the accumulating cylinder 60 is poured to the upper end opening of the sampling cylinder 70 at the fixed flow rate by the rotation of the supply roll 65. Since, in this respect, the quantity of discharge of the developer mix 20 at the lower end opening of the sampling cylinder 70 is set to be smaller than the quantity of the developer mix 20 which is fed by the rotation of the supply roll 65, part of the developer mix 20 overflows from the edge of the upper end opening of the sampling cylinder 70. Consequently, the stream of the developer mix 20 which descends inside the sampling cylinder 70 is extraordinarily stable, and the detection precision of the concentration of toner in the developer mix 20 to be detected by the detecting coil 80 is enhanced.

Figure 6:
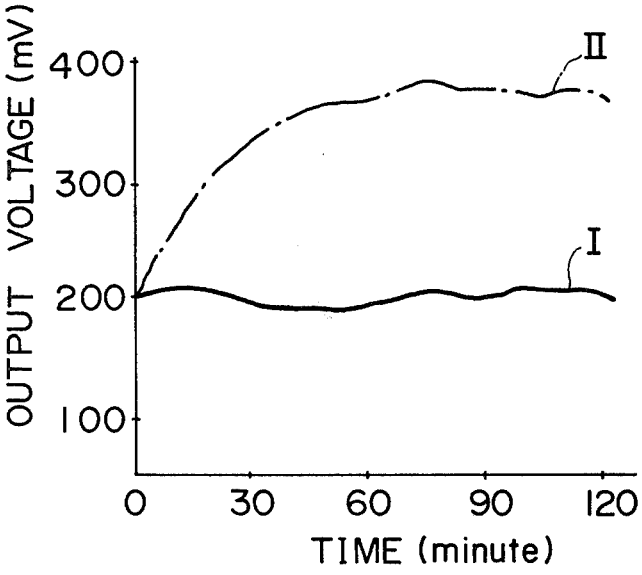
FIG. 6 is a graph showing the result of a measurement of the toner concentration of a developer mix by the apparatus illustrated in FIGS. 1 and 2.

In FIG. 6, curve I indicates a result in the case where a developer mix of a fixed toner concentration was actually measured by the embodiment illustrated in FIGS. 1 and 2. Output voltages from the detecting coil 80 are represented on the axis of ordinates of the graph, while periods of time are represented on the axis of abscissas. In the graph, for the sake of comparison, a result of measurement by prior-art apparatus for detecting a toner concentration is indicated by curve II. As apparent from the figure, with the prior-art apparatus, the output voltage has a tendency to increase with the lapse of time notwithstanding that the toner concentration in the developer mix is constant, whereas with the apparatus according to this invention, such a tendency is scarcely observed.

The reason why the output voltage of the apparatus according to this invention for monitoring the toner concentration in the developer mix is stable in this manner is that the quantity of the developer mix which is supplied to the upper end opening of the sampling cylinder 70 and the quantity of the developer mix which is discharged from the lower end opening thereof are limited so as to become constant, so that the flow rate of the developer mix inside the sampling cylinder 70 is stable even when the quantity of transportation of the developer mix by the rotary sleeve 32, etc. fluctuate.

Figure 3:
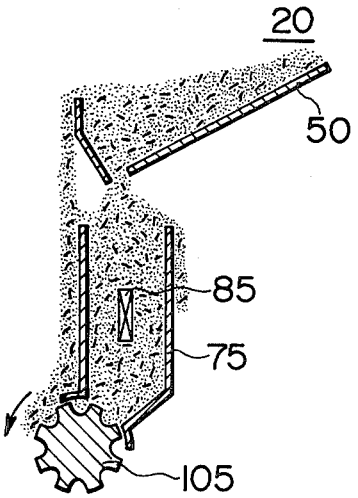
FIG. 3 shows a modification of the apparatus according to this invention for monitoring the toner concentration of a developer mix.

In a modification shown in FIG. 3, a hopper is formed of the guide plate 50. The hopper 50 is constructed so that part of the supplied developer mix 20 may overflow, and hence, the quantity of the developer mix 20 which is accumulated in the hopper 50 is held substantially constant. Therefore, a pressure which acts on the lower end opening part of the hopper 50 is stabilized, and the quantity of the developer mix 20 which falls towards the upper end opening of a sampling cylinder 75 becomes substantially constant. In this modification, a detecting coil 85 is disposed in the interior of the sampling cylinder 75. The detecting coil 85 is formed to be flat, and is arranged inside the sampling cylinder 75 in such a manner that it does not greatly disturb the stream of the developer mix 20 within the sampling cylinder 75. In this case, the material of the sampling cylinder 75 may be a magnetic material or a conductive material. An influence which the sampling cylinder 75 might exert on the detecting coil 85 can be eliminated by a shield effect owing to the developer mix 20. A grooved discharge roll 105 is disposed at the lower end opening part of the sampling cylinder 75, and discharges the developer mix 20 inside the cylinder to the exterior. In this modification, the relation between the quantity of the developer mix 20 to be supplied to the upper end opening of the sampling cylinder 75 and the quantity of discharge at the lower end opening thereof is set similarly to that in the foregoing embodiment.

Figure 4:
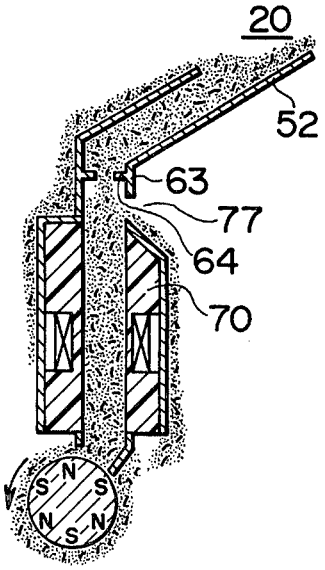
FIG. 4 shows another modification of the apparatus according to this invention for monitoring the toner concentration of a developer mix.

In a further modification shown in FIG. 4, a throttle plate 64 is provided at a lower part of an accumulating cylinder 63 which is formed integrally with a guide plate 52. The guide plate 52 is formed in the shape of a cylinder. The quantity of the developer mix 20 which is stored in the guide plate 52 and the accumulating cylinder 63 is held constant in such a manner that part of the developer mix overflows at the upper edge of the guide plate 52. Therefore, the flow rate of the developer mix 20 which is supplied to the upper end opening of the sampling cylinder 70 through the throttle plate 64 is held constant. A window 77 is provided at the upper end part of the sampling cylinder 70, and part of the developer mix 20 supplied towards the sampling cylinder 70 overflows through the window 77. Therefore, excessive cramming of the developer mix 20 into the sampling cylinder 70, etc. are avoided, and the developer mix 20 inside the sampling cylinder 70 flows down in a stable state.

Figure 5:
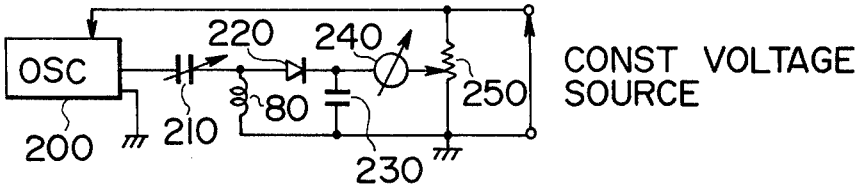
FIG. 5 is a circuit diagram showing a detector circuit which is applied to the apparatus of FIGS. 1 and 2 in order to detect the toner concentration of a developer mix as an inductance.

In the detector circuit shown in FIG. 5 for detecting the concentration of toner in the developer mix as an inductance, a fixed high frequency (100 kHz) from an oscillator 200 is bestowed on the detecting coil 80 through a capacitor 210. As previously stated, the detecting coil 80 is wound on the intermediate part of the sampling cylinder 70. The reactance of the detecting coil 80 and the capacitance of the capacitor 210 are selected so as to substantially resonate with the high frequency which is generated from the oscillator 200.

Reference numeral 220 designates a rectifier, and reference numeral 230 a smoothing capacitor. Reference numerals 240 and 250 designate an indicating meter and a potentiometer, respectively. A constant voltage from a constant voltage source is applied across the potentiometer 250. The potentiometer 250 is adjusted so that a terminal voltage which appears across the capacitor 210 when the developer mix of a reference toner concentration flows inside the sampling cylinder 70 may offer a reference level of the indicating meter 240. Therefore, the toner concentration of the developer mix appears on the indicating meter 240.

Although, in the embodiments described above, only the toner concentration of the developer mix having the magnetic carrier particles is detected, the application of this invention is not restricted to only the developer mix having such carrier particles. As carrier particles, there are nonmagnetic metal carrier particles, nonmetallic carrier particles etc. besides the magnetic carrier particles. This invention is also applicable to apparatus for detecting the toner concentration of a developer mix containing such carrier particles. That is, although in the foregoing embodiments the toner concentration of the developer mix is detected on the basis of the variation of the inductance of the detecting coil, the concentration of toner in the developer mix can alternatively be detected on the basis of a variation in the magnetic permeability, the magnetic flux density, the electric conductivity, the electrical loss, the color of a surface, or the like.

What we claim:

1. An apparatus for monitoring the concentration of toner in a mass of developer mix containing the toner and carrier particles, comprising:

a rotary sleeve having a peripheral surface that attracts said developer mix and that transports the developer mix;

a sampling cylinder inside which the developer mix flows;

means for detecting the concentration of the toner in the developer mix flowing inside said sampling cylinder;

a guide plate disposed above an upper end opening of said sampling cylinder for stripping away a part of the developer mix attached on the peripheral surface of said rotary sleeve and for supplying the part of the developer mix to an upper end opening of said sampling cylinder;

means disposed at a lower end opening of said sampling cylinder for discharging the developer mix inside said sampling cylinder at a fixed flow rate; and means disposed immediately superjacent to the upper end opening of said sampling cylinder for limiting a flow rate of the developer mix to be supplied to said sampling cylinder, whereby the rate of flow of developer mix inside said sampling cylinder is stable.

2. Apparatus as claimed in claim 1, wherein the flow rate of the developer mix to be supplied to said sampling cylinder is set to be greater than the flow rate of the developer mix to be discharged from said sampling cylinder, whereby part of the developer mix to be supplied to said sampling cylinder overflows from an upper edge of said sampling cylinder.

3. Apparatus as claimed in claim 1, wherein the flow rate of the developer mix to be discharged from said sampling cylinder is set so that a velocity of flow of the developer mix inside said sampling cylinder may become lower than a velocity of natural fall.

4. An apparatus for monitoring the concentration of toner in a mass of developer mix containing the toner and carrier particles, comprising:

a rotary sleeve having a peripheral surface that attracts said developer mix and that transports the developer mix;

a sampling cylinder inside which the developer mix flows;

a detecting coil which is disposed on an outer periphery of said sampling cylinder and which detects the concentration of the toner in the developer mix in the form of an inductance;

an accumulating cylinder which is disposed above an upper end opening of said sampling cylinder and which supplies the developer mix to said sampling cylinder;

a guide plate for removing a part of the developer mix attracted on the outer peripheral surface of said rotary sleeve and for introducing the part of the developer mix to an upper end opening of said accumulating cylinder, said guide plate being formed integrally with said accumulating cylinder;

means disposed inside said accumulating cylinder for limiting a flow rate of the developer mix supplied to said sampling cylinder to be constant; and means disposed at a lower end opening of said sampling cylinder for discharging the developer mix inside said sampling cylinder at a fixed flow rate.

5. Apparatus as claimed in claim 4, wherein a flow rate of the developer mix to be supplied to said accumulating cylinder by said guide plate is set to be greater than the flow rate of the developer mix to be limited by the limiting means, whereby part of the developer mix supplied towards said accumulating cylinder overflows from an upper edge of said accumulating cylinder, and the flow rate of the developer mix to be supplied to said sampling cylinder is set to be greater than the flow rate of the developer mix to be discharged from said sampling cylinder, whereby part of the developer mix supplied towards said sampling cylinder overflows from an upper edge of said sampling cylinder.

6. Apparatus for monitoring the concentration of toner in a mass of developer mix including the toner and carrier particles, comprising:

a sampling cylinder inside which the developer mix flows;

a detecting coil which is disposed on an outer periphery of said sampling cylinder and which detects the concentration of the toner in the developer mix in the form of an inductance;

an accumulating cylinder which is disposed above an upper end opening of said sampling cylinder and which supplies the developer mix to said sampling cylinder;

a guide plate which is formed integrally with said accumulating cylinder and which supplies the developer mix to said accumulating cylinder;

means disposed inside said accumulating cylinder for limiting a flow rate of the developer mix supplied to said sampling cylinder to be constant, said limiting means including a roll which is formed with grooves in a cylindrical surface thereof; and means disposed at a lower end opening of said sampling cylinder for discharging the developer mix inside said sampling cylinder at a fixed flow rate.

7. Apparatus as claimed in claim 4, wherein said accumulating cylinder and the limiting means are made up of a hopper which is formed integrally with said guide plate.

8. Apparatus as claimed in claim 4, wherein the limiting means is made up of a throttle plate which is disposed at a lower end part of said accumulating cylinder.

9. Apparatus for monitoring the concentration of toner in a mass of developer mix including the toner and carrier particles, comprising:

a sampling cylinder inside which the developer mix flows;

a detecting coil which is disposed on an outer periphery of said sampling cylinder and which detects the concentration of the toner in the developer mix in the form of an inductance;

an accumulating cylinder which is disposed above an upper end opening of said sampling cylinder and which supplies the developer mix to said sampling cylinder;

a guide plate which is formed integraly with said accumulating cylinder and which supplies the developer mix to said accumulating cylinder;

means disposed inside said accumulating cylinder for limiting a flow rate of the developer mix supplied to said sampling cylinder to be constant; and means disposed at a lower end opening of said sampling cylinder for discharging the developer mix inside said sampling cylinder at a fixed flow rate, said discharging means being a magnet roll.

10. Apparatus for monitoring the concentration of toner in a mass of developer mix including the toner and carrier particles, comprising:

a sampling cylinder inside which the developer mix flows;

a detecting coil which is disposed on an outer periphery of said sampling cylinder and which detects the concentration of the toner in the developer mix in the form of an inductance;

an accumulating cylinder which is disposed above an upper end opening of said sampling cylinder and which supplies the developer mix to said sampling cylinder;

a guide plate which is formed integrally with said accumulating cylinder and which supplies the developer mix to said accumulating cylinder;

means disposed inside said accumulating cylinder for limiting a flow rate of the developer mix supplied to said sampling cylinder to be constant; and means disposed at a lower end opening of said sampling cylinder for discharging the developer mix inside said sampling cylinder at a fixed flow rate, said discharging means being a roll which is formed with grooves in a cylindrical surface thereof.

11. An apparatus for monitoring the concentration of toner in a mass of developer mix containing the toner and carrier particles, which comprises:

a reservoir for containing a mass of developer mix;

a rotary sleeve disposed partially within said reservoir, said rotary sleeve having a peripheral surface that attracts said developer mix and that transports a portion of the developer mix from said reservoir on said peripheral surface;

a sampling means defining a passage in which the developer mix flows;

means operatively associated with said sampling means for detecting the concentration of toner in the developer mix flowing inside said passage;

a guide means for guiding developer mix from said rotary sleeve to said sampling means, said guide means including means for stripping off a part of the developer mix attracted onto and transported by the rotary sleeve;

means for limiting a flow rate of the developer mix to one end of the passage defined by said sampling means; and means disposed at the other end of said passage for discharging the developer mix inside said passage at a fixed flow rate whereby the developer mix flows within said passage in a stable manner.

12. An apparatus as claimed in claim 13, wherein said rotary sleeve rotates in a direction so that the peripheral surface moves towards the guide means, said guide means including a plate having an edge positioned immediately adjacent the peripheral surface of said rotary sleeve.

13. An apparatus as claimed in claim 11 wherein the passage defined by said sampling means has an upper end opening that is spaced below the means for limiting the flow rate of the developer mix, whereby excess developer mix supplied to said sampling means overflows said upper end opening and falls by gravity into said reservoir.

14. An apparatus as claimed in claim 11 wherein said guide means includes an accumulating passage having a lower end opening in which the means for limiting the flow rate of the developer mix to be supplied to the sampling means is disposed, said accumulating passage being spaced above said sampling means.

* * * * *